United States Patent [19]

Villeneuve

[11] Patent Number: 4,744,721

[45] Date of Patent: May 17, 1988

[54] TURBOPUMP SEALING DEVICE

[75] Inventor: Michel Villeneuve, Saint Marcel, France

[73] Assignee: EG & G Sealol, Coignieres, France

[21] Appl. No.: 924,563

[22] Filed: Oct. 28, 1986

[30] Foreign Application Priority Data

Nov. 8, 1985 [FR] France ..... 85 16595

[51] Int. Cl.[4] ..... F01D 25/16

[52] U.S. Cl. ..... 415/113; 415/174; 277/65; 277/83; 384/479; 384/483

[58] Field of Search ..... 415/173 R, 174, 113, 415/110; 277/65.83, 88.89; 384/479, 483

[56] References Cited

U.S. PATENT DOCUMENTS

| | | | |
|---|---|---|---|
| 2,215,034 | 9/1940 | Gorman | 415/170 A |
| 2,322,867 | 6/1943 | Meyer | 415/173 R |
| 2,575,549 | 11/1951 | Doble | 415/170 A |
| 3,260,530 | 7/1966 | Jelatis et al. | 277/65 |
| 3,977,685 | 8/1976 | Greenawalt et al. | 277/89 |
| 4,294,454 | 10/1981 | Cannings | 277/81 R |
| 4,377,290 | 3/1983 | Netzel | 277/65 |

FOREIGN PATENT DOCUMENTS

| | | | |
|---|---|---|---|
| 3343685 | 6/1985 | Fed. Rep. of Germany | 415/173 R |

*Primary Examiner*—Robert E. Garrett
*Assistant Examiner*—John T. Kwon
*Attorney, Agent, or Firm*—Browdy & Neimark

[57] ABSTRACT

A turbopump sealing device is mounted in a case concentric with the rotary shaft between the turbine and the pump, the case defining a cavity for pressurizing gas, defined on the turbine side by a bearing ring which is integral therewith, in contact with a first floating ring secured against rotation and, on the pump side, by an applied shell one face of which is in contact with a second floating ring secured against rotation, itself bearing on a friction ring integral with the shaft, such rings being mounted on a socket concentric with the shaft, the shell being further connected to the cavity by a bellows.

15 Claims, 2 Drawing Sheets

TURBOPUMP SEALING DEVICE

BACKGROUND OF THE INVENTION

The present invention relates to a turbopump sealing device, more particularly for equipping liquid propergol supply units for rocket motors.

It is known that modern rocket motors using liquid propergols, usually oxygen and hydrogen, are equipped with pumps for conveying the fluid (liquid hydrogen) and the oxidant (liquid oxygen) from the reservoirs to the combustion chamber at a given pressure and flow rate. These pumps are driven directly or through a gear box by a turbine operating from combustion gases supplied by a gas generator or combustion prechamber. The shaft common to the pump and to the turbine is supported by bearings usually lubricated by a flow of hydrogen, all or part of which is discharged during operation of the motor towards the turbine compartment.

Whether it is a turbine between two bearings or cantilevered, with a single bearing, there should be incorporated between the bearing and the turbine a sealing means having a dual role:

(a) cold period:

This is the period preceding start up of the motor in which the turbopump is placed in contact with the ergols at very low temperature and at a relatively low pressure, close to that of the reservoirs, so that on start up of rotation thermal operating conditions are already established close to those of operation.

During this phase, the sealing means for safety reasons must perfectly isolate the ergols, particularly the hydrogen, from the turbine compartment.

If this function is not ensured, the hydrogen accumulates at the level of the motor or in the interstage space if it is a motor used in one of the upper stages of the launcher, and there is a high risk of explosion when the motor is ignited.

(b) operation:

During the whole operating time of the motor, the sealing means must allow the hydrogen passing through the bearings to be discharged towards the turbine compartment and in addition, with certain lubrication systems, it must fix the hydrogen flow at a predetermined value necessary for the correct operation of the bearings.

From the foregoing, it is clear that the turbine sealing means is particularly critical and its design must therefore allow sure and reliable operation.

The sealing means at present used are of several types:

labyrinths
facial contact seals,
facial retractible seals
floating rings
segmented seals.

The above mentioned elementary means are used singly or else different combinations of two or more of them are used. Certain assemblies are pressurized, others use hydrodynamic effects.

SUMMARY OF THE INVENTION

The device of the present invention uses some of the above elementary means, in a new arrangement allowing performances to be obtained superior to those of existing combinations, in particular:

non possibility of hydrogen leak to the turbine during the cold period,
reduced consumption of the pressurization gas,
control of the hydrogen flow to the turbine,
increased life span,
reduced size and weight,
greater reliability.

In accordance with the invention, in a preferred embodiment, the sealing device is mounted in a case concentric with the rotary shaft between the turbine and the pump properly speaking, said case defining a cavity for a pressurizing gas, defined on the turbine side by a bearing ring which is integral therewith, in contact with a first floating ring secured against rotation and, on the pump side, by an applied shell one face of which is in contact with a second floating ring secured against rotation, itself bearing on a friction ring integral with the shaft, said rings being mounted on a socket concentric with said shaft, the shell being further connected to the cavity by a bellows.

BRIEF DESCRIPTION OF THE DRAWINGS

Other features and advantages of the invention will be clear from the following description of possible embodiments, with reference to the accompanying drawings in which.

In these drawings, the same reference designate the same elements.

DESCRIPTION OF THE PREFERRED EMBODIMENT

Figure 1:
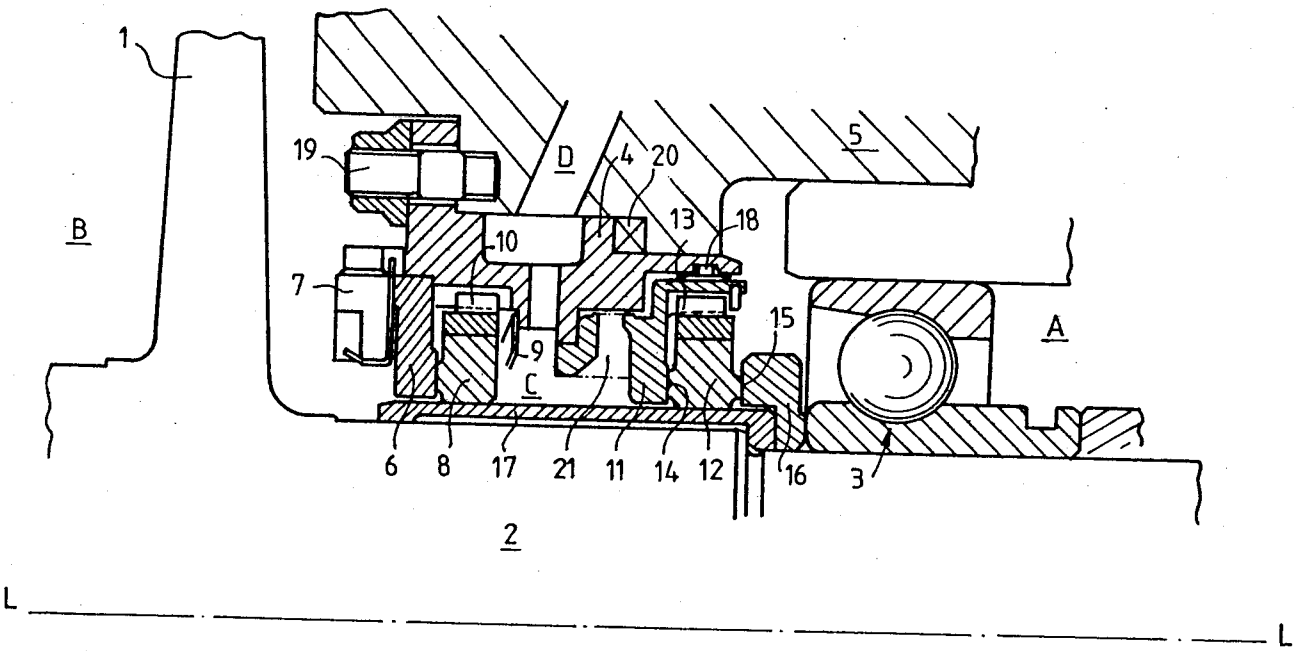
FIG. 1 shows a schematical sectional view of the device of the invention in its first embodiment.

Referring to FIG. 1, a turbine 1 is mounted for rotation on a shaft 2 with longitudinal axis L—L driving a pump (not shown) and including a bearing such as a ball bearing 3. The sealing device comprises a case 4 included in a general casing 5. Case 4 defines a cavity C for a pressurizing gas through a duct D, as will be explained hereafter, itself defined by the following arrangement:

on the turbine 1 side by a bearing ring 6 held in the case, for example by a nut 7, on which bears a first floating ring 8 urged for example by a spring 9, said ring 8 being formed of a carbon ring clamped in a metal collar secured against rotation by engagement of studs 10 of the collar in corresponding housings in the case;

on the pump bearing 3 side, by an added shell 11 in which is disposed a second floating ring 12 of the same type as the preceding one and similarly secured against rotation by engagement of studs 13 of its collar in corresponding housings in shell 11; the floating ring 12 bears by a contact face 14 on shell 11 and, on the other hand, it may also bear by a contact surface 15 on a friction ring 16 integral with shaft 2.

As mentioned above, the two floating rings 8, 12 and the bearing ring 6 as well as the friction ring 16 are mounted about a socket 17 concentric to shaft 2. Advantageously, a vibration damper 18 is inserted between shell 11 and its housing in case 4, so as to prevent any amplification of the vibrations generated during operation. The whole of the device, that is to say case 4, is fixed on a general casing 5 by any appropriate means, for example by stud bolt-nut assemblies 19, a static seal 20 providing sealing with respect to the casing.

With the second floating ring 12 being intended to have a clearance in the longitudinal direction and to be followed along the contact face 14 by shell 11, as will be explained hereafter, this latter is secured to the case by means of a metal bellows 21 guaranteeing the continuity of enclosure C and preventing any passage of fluid. The bellows 21, because of its stiffness and a precompression on assembly, further provides an initial shell/floating ring 12/friction ring 16 contact force.

For the operation of the device such as described above, three phases should be distinguished, namely the cold period, the transitory period and the operating period properly speaking.

Figure 2:
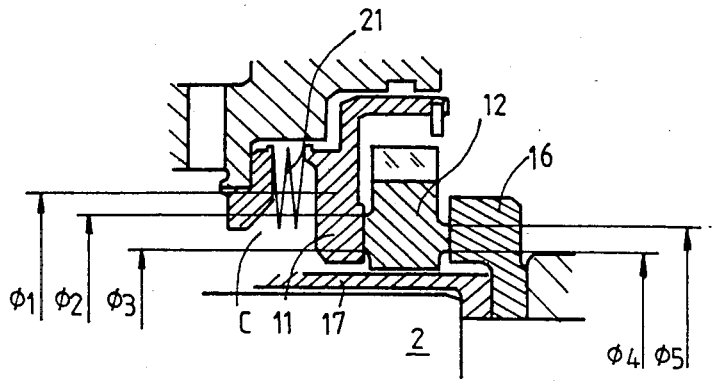
FIG. 2 shows a simplified diagram of the device of FIG. 1 illustrating the diameters used for obtaining the best results.
Figure 3:
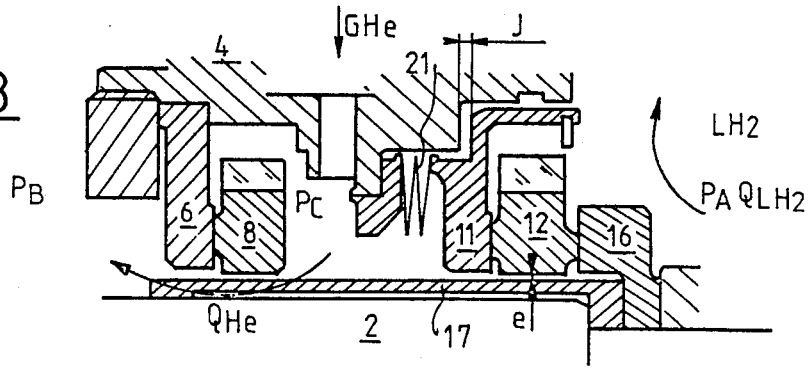
FIGS. 3 and 4 show diagrams illustrating the operating conditions of the device.
Figure 4:
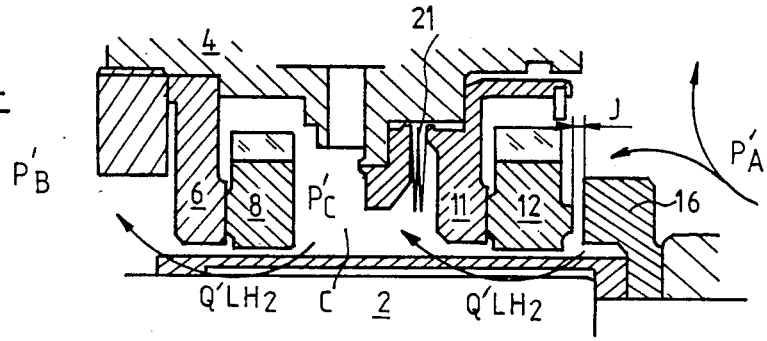

Referring to FIGS. 2 to 4, the configuration of the device during the cold period is shown in FIG. 3.

Cavity C is pressurized, in the usual way, by helium gas (GHe), at a pressure $P_c$ such that the force tending to place the bearing 12 side ring in contact with its friction ring 16 is greater than the force tending to separate it:

$$P_c \times (\phi_1^2 - \phi_3^2) > P_A \times (\phi_1^2 - \phi_5^2)$$

in which expression: $\phi_1$, $\phi_3$, $\phi_5$ are respectively the diameters of the cavity, of the inner edge of surface 14 and of the outer edge of surface 15; and $P_A$ is the pressure of the hydrogen at the level of the pump. It should be noted that there has also been shown in FIG. 2 the diameters $\phi_2$ of the outer edge of surface 14 and $\phi_4$ of the inner edge of surface 15.

If $P_c$ is imposed, $\phi_3$ and $\phi_5$ are determined so that the above inequality is respected.

So as to maintain contact between ring 12 and shell 11 in all cases of operation, the following must also be respected:

$$\phi_2 > \phi_5$$

Sealing with the cavity C of the bearing is provided by the metal bellows 21 and the contacts (lapped surfaces for example) between shell 11, ring 12 and bearing ring 6.

So as to prevent any leak, however small, from bearing 3 towards cavity C, a second condition is imposed on the pressurization (leak from C to the bearing):

$$P_c > P_A$$

Thus, the leak of pressurizing gas, so consumption thereof, is practically zero on the bearing side.

On the turbine side, ring 8 limits the consumption of pressurizing gas (leak flow rate $Q_{He}$ to the turbine cavity B).

During the transitory phase, turbine 2 is set in rotation up to its full operating speed, the turbine pressure $P_B$ increases from the partial vacuum (case of the upper stage motor of launchers) or the normal atmospheric pressure (case of the first stage) as well as the bearing pressure.

During the transitory phase the pressurization is stopped and bellows 21 is retracted, removing the contact between ring 12 and the friction ring 16.

The configuration of the device during the operating phase is shown in FIG. 4.

Bellows 21 is compressed and shell 11 bears on the case, forming a clearance J between ring and bearing ring.

With the pressurization cut off and the turbine pressure $P_B$ less than the bearing pressure $P_A$, a flow $Q'_{LH2}$ is established from bearing 3 towards the turbine 2.

The sealing device behaves then like a system with two rings in series, the pressure $P_c$ being established at a value between $P_A$ and $P_B$.

It is then a system without contact between stationary parts and rotary parts, which has the following advantages:

reduction of the consumed power removal of friction so of wear (increased lifespan), increased reliability.

In the case where the system must fix the hydrogen flow towards the turbine a clearance "e" between ring 12 and socket 17 is determined correspondingly.

The consumption of pressurizing gas is particularly critical and must be reduced as much as possible for the following reasons:

economic: ground consumption reduced airborne weight: flight consumption (after ground/flight pressurization switching).

On the bearing side, the pressurization consumption is practically zero as mentioned above, it is therefore on the turbine side that action must be taken if it is desired to further reduce consumption.

Figure 5:
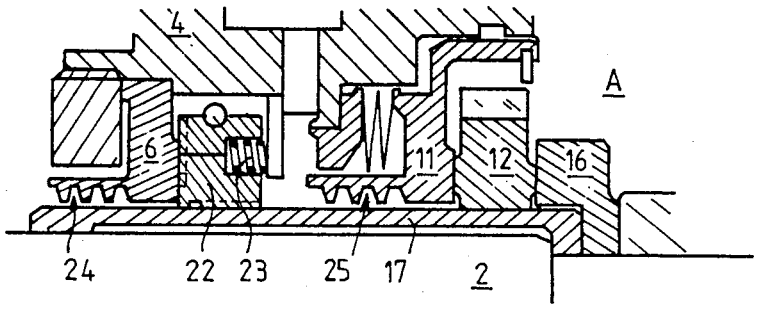
FIG. 5 shows a schematical sectional view of a variant of the device of FIG. 1.

For that, in replacement of ring 8 a segmented ring 22 (FIG. 5) may be used which ensures contact both with the bearing ring 6 and with socket 17 during the cold period, the order of size of the leak being then ten times less than that obtained with the ring. As in the case of ring 8, the segmented ring 22 is urged into contact with the bearing ring 6 by spring 23.

In operation, this segmented ring 22 must be cooled. It must then have a hydrodynamic effect so that the segments separate from the socket under the action of the rotation, thus forming a clearance between ring and socket which allows a hydrogen flow. The absence of contact during operation reduces the power consumed and allows cooling.

Reduction of the consumption may also be obtained by using a second ring in series with the first one (8).

So as to obtain a further increase in reliability, one or two labyrinths 24, 25 may be added to the device downstream of the bearing and friction rings 6, and 16, which limit the hydrogen flow during operation should the rings fail.

The loss of pressurization should also be taken into account as a particularly critical failure in the case of an upper stage of a launcher.

The consequences of a loss of pressurization are minimized by defining the bellows 21 so that its initial force $F_R$ provided by its stiffness is greater than the opening force caused by the bearing pressure, in accordance with the expression:

$$F_R + P_C \times \frac{\pi}{4}(\phi_1^2 - \phi_3^2) < P_A \times \frac{\pi}{4}(\phi_1^2 - \phi_5^2)$$

Referring again to FIG. 5, it should be noted that among the advantages of the segmented ring 22 may be mentioned the fact that it is permanently in contact with ring 6 and socket 17, whatever the variations in dimensions due to the temperature gradients.

The present invention has of course only been described and shown by way of explanatory example which is in no wise limiting and that any useful modification may be made thereto particularly in the field of technical equivalences without departing from the scope and spirit of the invention.

I claim:

1. A turbopump sealing device for a fluid such as a liquid propergol having at least one floating ring, mounted in a case concentric with a rotary shaft connecting a turbine and a pump together, said device including:

a cavity defined by said case for a pressurizing gas, said cavity being defined on the turbine side by a bearing ring which is integral therewith, in contact with a first sealing ring secured against rotation, said cavity being defined on said pump side by an added shell one fact of which is in contact with a contact face of a second sealing ring secured against rotation, said second sealing ring having a contact surface on its side opposite said contact face, said contact surface bearing on a friction ring integral with said shaft, said bearing and friction rings being mounted on a socket concentric with said shaft, said shell being further connected to said cavity by a bellows, said cavity having an outer diameter $\phi_1$, said contact face having an outer diameter $\phi_2$ and an inner diameter $\phi_3$, and said contact surface having an outer diameter $\phi_5$ and an inner diameter $\phi_4$, and wherein $\phi_1$ is greater than $\phi_2$ which is greater than $\phi_5$, whereby means are provided for effecting tight sealings between said turbine and said pump during a cold period and for providing controlled leakage towards said turbine during an operation stage.

2. A device as claimed in claim 1, wherein said case is fixed to a casing by means of a static seal.

3. The device as claimed in claim 1, wherein said first sealing ring on turbine side is formed by a floating ring mounted on said socket and urged by a spring in contact with said bearing ring.

4. The device as claimed in claim 1, wherein said first sealing ring on the turbine side is formed by a segmented ring urged by a spring in contact with said bearing ring.

5. The device as claimed in claim 1, wherein said shell is extended downstream of the pump by a labyrinth.

6. The device as claimed in claim 1, wherein said bearing ring is extended downstream of the pump by a labyrinth.

7. The device as claimed in claim 1, wherein said shell and said bearing ring are both extended downstream of the pump by a labyrinth.

8. A turbopump sealing device for a fluid such as a liquid propergol having at least one floating ring, mounted in a case concentric with a rotary shaft connecting a turbine and a pump together, said device including:

a cavity defined by said case for a pressurizing gas, said cavity being defined on the turbine side by a bearing ring which is integral therewith, in contact with a first sealing ring secured against rotation, said cavity being defined on said pump side by an added shell one fact of which is in contact with a second sealing ring secured against rotation, said second ring bearing on a friction ring integral with said shaft, said bearing and friction rings being mounted on a socket concentric with said shaft, said shell being further connected to said cavity by a bellows, wherein a vibration damper is inserted between said shell and said case.

9. A device as claimed in claim 8, wherein said case is fixed to a casing by means of a static seal.

10. The device as claimed in claim 8, wherein said first sealing ring on the turbine side is formed by a floating ring mounted on said socket and urged by a spring in contact with said bearing ring.

11. The device as claimed in claim 8, wherein said first sealing ring on the turbine side is formed by a segmented ring urged by a spring in contact with said bearing ring.

12. The device as claimed in claim 8, wherein said shell is extended downstream of the pump by a labyrinth.

13. The device as claimed in claim 8, wherein said bearing ring is extended downstream of the pump by a labyrinth.

14. The device as claimed in claim 8, wherein said shell and said bearing ring are both extended downstream of the pump by a labyrinth.

15. A device as claimed in claim 8, further comprising means to supply hydrogen as the pump fluid, and means to supply helium as the gas compressurizing said cavity.

* * * * *